US007476884B2

(12) United States Patent
Gaebel et al.

(10) Patent No.: US 7,476,884 B2
(45) Date of Patent: Jan. 13, 2009

(54) DEVICE AND METHOD FOR GENERATING EXTREME ULTRAVIOLET (EUV) RADIATION

(75) Inventors: Kai Gaebel, Jena (DE); Juergen Kleinschmidt, Goettingen (DE)

(73) Assignee: XTREME technologies GmbH, Jena (DE)

( * ) Notice: Subject to any disclaimer, the term of this patent is extended or adjusted under 35 U.S.C. 154(b) by 353 days.

(21) Appl. No.: 11/354,324

(22) Filed: Feb. 14, 2006

(65) Prior Publication Data

US 2006/0192157 A1 Aug. 31, 2006

(30) Foreign Application Priority Data

Feb. 15, 2005 (DE) ..... 10 2005 007 884

(51) Int. Cl.
*H05H 1/04* (2006.01)

(52) U.S. Cl. ..... 250/504 R; 376/119

(58) Field of Classification Search ..... 250/504 R; 372/86; 315/111.21; 378/119
See application file for complete search history.

(56) References Cited

U.S. PATENT DOCUMENTS 6,304,630 B1 10/2001 Bisschops et al.
6,815,900 B2 * 11/2004 Ahmad et al. ..... 315/111.21
6,894,298 B2 * 5/2005 Ahmad et al. ..... 250/504 R
2003/0068012 A1 * 4/2003 Ahmad et al. ..... 378/119
2003/0223546 A1 12/2003 McGregor et al.
2004/0145292 A1 * 7/2004 Ahmad et al. ..... 313/231.31
2004/0160155 A1 * 8/2004 Partlo et al. ..... 313/231.31
2004/0170252 A1 9/2004 Richardson
2004/0238762 A1 12/2004 Mizoguchi et al.
2005/0230645 A1 * 10/2005 Melnychuk et al. ..... 250/504 R
2007/0045573 A1 * 3/2007 Kleinschmidt et al. .. 250/504 R
2007/0114946 A1 * 5/2007 Goetze et al. ..... 315/111.21

FOREIGN PATENT DOCUMENTS

DE 102 19 173 11/2003
EP 1 109 427 6/2001
WO WO 2004/084592 9/2004
WO WO 2005/004555 1/2005

* cited by examiner

*Primary Examiner*—Jack I Berman
*Assistant Examiner*—Johnnie L Smith, II
(74) *Attorney, Agent, or Firm*—Reed Smith LLP

(57) ABSTRACT

It is the object of a device and method for generating extreme ultraviolet (EUV) radiation to overcome the obstacles formerly posed by the use of efficient metal emitters so that the conversion efficiency can be optimized and, as a result, the radiation output can be increased without shortening the useful life of the collector optics and electrode system. An injection nozzle of an injection device is directed to a discharge area located in a discharge chamber. The injection nozzle supplies a series of individual volumes of a source materials for the electric discharge serving to generate radiation at a repetition rate that corresponds to the frequency of the gas discharge. Further, provision is made for successively vaporizing the individual volumes in the discharge area.

32 Claims, 2 Drawing Sheets

DEVICE AND METHOD FOR GENERATING EXTREME ULTRAVIOLET (EUV) RADIATION

CROSS-REFERENCE TO RELATED APPLICATION

This application claims priority of German Application No. 10 2005 007 884.2, filed Feb. 15, 2005, the complete disclosure of which is hereby incorporated by reference.

BACKGROUND OF THE INVENTION a) Field of the Invention

The invention is directed to a device for generating extreme ultraviolet (EUV) radiation. The device contains a discharge chamber which has a discharge area for a gas discharge in order to form a plasma that emits the radiation, a first electrode and a second electrode which are electrically separated from one another by an insulator with dielectric rigidity, an outlet opening which is provided in the second electrode for the radiation emitted by the plasma, and a high-voltage power supply for generating high-voltage pulses for the two electrodes.

Further, the invention is directed to a method for generating extreme ultraviolet (EUV) radiation in which a plasma emitting the radiation is generated in a discharge area of a discharge chamber from a source material for an electric discharge by means of gas discharge.

b) Description of the Related Art

Radiation sources which are based on plasmas generated by gas discharge and rely on various concepts have already been described many times. The principle common to these devices consists in that a pulsed high-current discharge of more than 10 kA is ignited in a gas of determinate density and a very hot (kT>30 eV) and dense plasma is generated locally as a consequence of the magnetic forces and the dissipated power in the ionized gas.

Further developments have aimed above all to solutions characterized by a high conversion efficiency and a long life of the electrodes. The problems to be solved stem in part from the dilemma that increasing the distance between the plasma and electrodes, which has a positive effect on the life of the electrodes, leads to reduced efficiency of the collector optics because of the resulting increase in generated plasma, so that there is a reduction in overall efficiency with respect to the power achieved at the intermediate focus for the applied electrical input power for the discharge.

It has been shown that the radiation outputs which were still not sufficient heretofore for lithography using extreme ultraviolet radiation apparently can only be further increased significantly by means of efficient emitter substances such as tin or lithium or combinations thereof (DE 102 19 173 A1).

Tin and lithium have the substantial disadvantage of a high level of debris, so that the collector optics used for bundling and deflecting the EUV radiation are subject to increased contamination.

DE 102 19 173 A1 already addresses the technical problem that when metal emitters are used very high temperatures of the discharge source are required for vaporization and a condensation of the metal vapors inside the source must be prevented if malfunction is to be avoided.

OBJECT AND SUMMARY OF THE INVENTION

Therefore, it is the primary object of the invention to overcome these obstacles connected with efficient metal emitters so that, through their use, the conversion efficiency can be optimized and, as a result, an increased radiation output can be achieved without resulting in a reduced life of the collector optics and electrode system.

According to the invention, this object is met by a device for generating extreme ultraviolet (EUV) radiation of the type mentioned above in that an injection nozzle of an injection device is directed to the discharge area and provides a series of individual volumes of a source material for an electric discharge serving to generate radiation at a repetition rate corresponding to the frequency of the gas discharge, and in that arrangements are provided for successive vaporization of the individual volumes in the discharge area.

A gas supply unit which supplies a background gas flowing through the discharge area for the gas discharge can advantageously be provided.

The injection device can have different injection directions. An injection direction facing toward the outlet opening is preferred. However, it can also be directed through the outlet opening in the second electrode to the discharge area.

The injection nozzle is connected to a liquid reservoir which communicates with a temperature-control device and with a device for providing a continuous reservoir pressure on the source material for the electric discharge located in the liquid reservoir.

In an advantageous construction, a thinning device which removes individual volumes from a continuous flow of individual volumes is arranged downstream of the injection nozzle in the injection direction.

A thinning device comprising a module for electrical charging and an interceptor for removal of charged individual volumes is suitable for this removal.

Another thinning device provides a rotating diaphragm having pass-through areas and interception areas which increases the distance between the individual volumes by selectively interrupting the flow of individual volumes and which communicates with means for preventing the adherence of excess individual volumes that have been separated out.

Alternatively, the individual volumes can also exit the injection nozzles in a properly proportioned manner already in that the injection nozzle is connected to the liquid reservoir via an input-side nozzle chamber and a pressure modulator for temporarily changing the volume in the nozzle chamber acts on this liquid reservoir, wherein the nozzle outlet of the injection nozzle opens into a pre-chamber in which there is a pre-chamber pressure equal to the reservoir pressure and which contains an opening that is directed to the discharge area for the passage of the individual volumes.

When an acceleration path for the individual volumes is provided in an area between the injection nozzle and the second electrode, the spacing and velocity of the individual volumes can be better adapted to the process of plasma generation.

According to the invention, at least one vaporization laser can be provided as means for successively vaporizing the individual volumes, or the gas discharge of the background gas is used, or the two means are combined.

The laser beam emitted by a vaporization laser can be guided into the discharge area either through an opening made in the second electrode or through the existing outlet opening.

An intercepting device for the vaporized work medium is advantageously arranged in the center of a debris mitigating device arranged downstream of the second electrode. The intercepting device is preferably constructed as an off-pump tube with an inlet opening which faces the outlet opening in the second electrode and with a pump connection. In order to prevent condensation of elemental components of the source material for the electric discharge, at least one heating element is connected to the off-pump tube which is at least partially enclosed by an insulating jacket.

Further, the invention can be constructed in such a way that a preionization module for preionization of the background gas is arranged inside the first electrode. The preionization module comprises a first preionization electrode, which is electrically insulated from the first electrode serving as second preionization electrode by a tubular insulator, and a preionization pulse generator which is connected to the preionization electrode and the first electrode.

Further, the above-stated object is met according to the invention by a method for generating extreme ultraviolet (EUV) radiation of the type mentioned in the beginning in that the source material for the electric discharge is provided in individual volumes which are introduced successively through a directed injection into the discharge chamber at a repetition rate corresponding to the frequency of the gas discharge and are vaporized.

According to the inventive method, the vaporization and the subsequent plasma generation can be carried out in different ways.

In a first embodiment, at least one laser beam pulse is directed to the individual volume for vaporization, whereupon the gas discharge serving to generate plasma occurs in the vaporized source material for the electric discharge.

Alternatively, the vaporization and the plasma generation can be carried out by the discharging of a background gas flowing through the discharge chamber.

Further, it is possible to bring about the vaporization through the combination of at least one laser beam pulse and the discharge of a background gas flowing through the discharge chamber.

In a preferred embodiment variant of the method, the vaporized individual volumes are pumped out of the discharge chamber after plasma generation.

In addition, in order to supply the individual volumes so as to be adapted to frequency by eliminating excess individual volumes from a flow of individual volumes that is generated by continuous injection, or through a pulsed injection that is adapted to the frequency of the plasma generation, it can be advantageous when another flow of individual volumes which does not coincide with the movement direction of the injected individual volumes is directed through the discharge chamber between the plasma generated from a first individual volume and a subsequent volume. The vaporization of a subsequent volume by existing plasma can be prevented in this way.

Other appropriate and advantageous embodiments and further developments of the device according to the invention and of the method according to the invention are indicated in the subclaims.

The invention will be described more fully in the following with reference to the schematic drawings.

DESCRIPTION OF THE PREFERRED EMBODIMENTS

Figure 1:
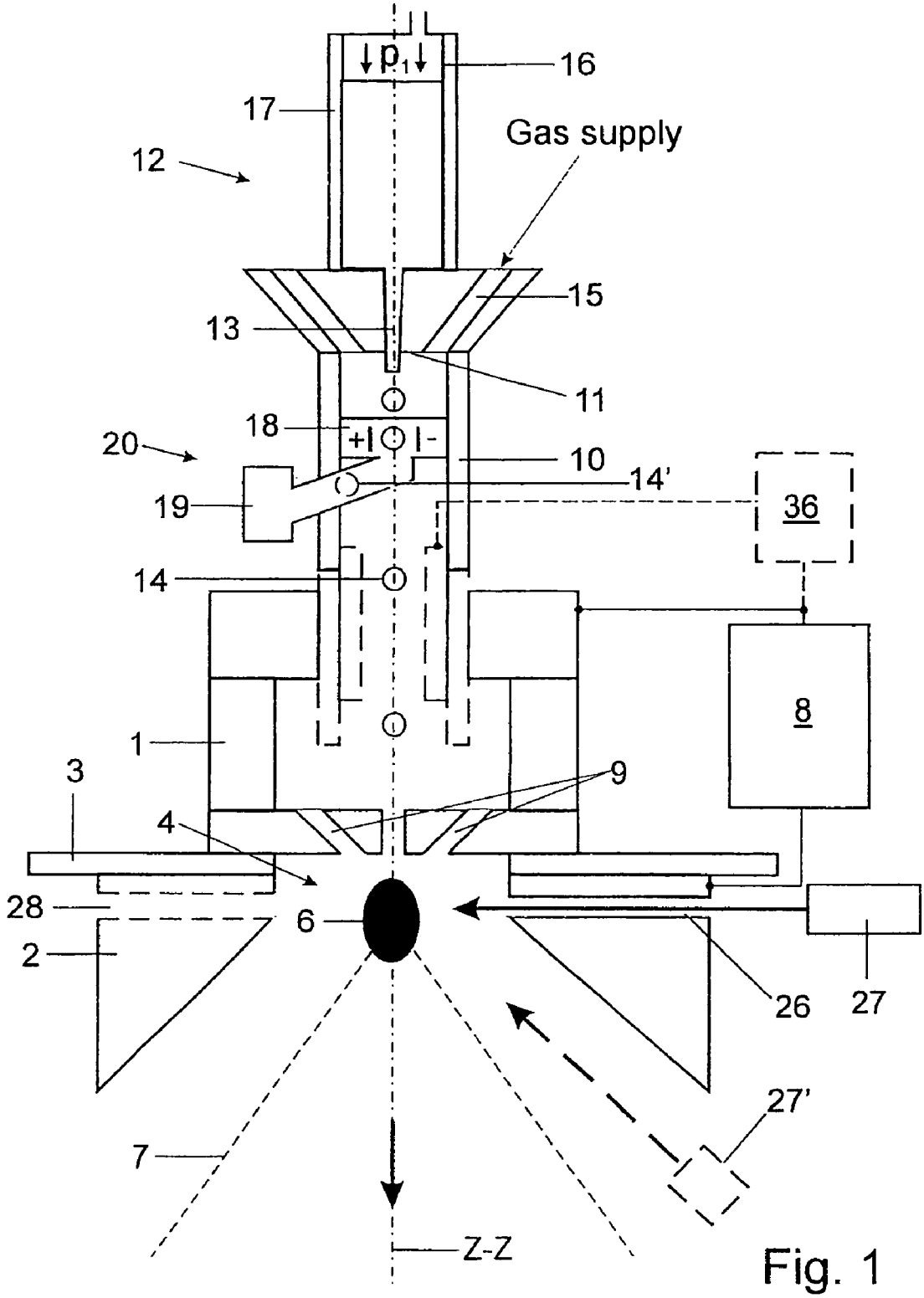
FIG. 1 shows a first construction of an EUV radiation source based on a gas discharge with laser vaporization of injected individual volumes.

The EUV radiation source shown in FIG. 1 contains a first electrode 1 and a second electrode 2 which are separated from one another electrically by an insulator 3 with dielectric rigidity. A discharge chamber 4 contains a discharge area for a pulsed gas discharge for forming a dense, hot plasma 6 which emits the radiation. The radiation 7 emitted by the plasma 6 can exit from the EUV radiation source through the second electrode 2 which is open toward one side.

By generating high-voltage pulses with a repetition rate between 1 Hz and 20 kHz and with a pulse size sufficient for this purpose, a high-voltage pulse generator 8 connected to the two electrodes 1 and 2 ensures that the plasma 6 can emit the desired EUV radiation.

In radially symmetric openings 9 incorporated in the first electrode 1, there are plasma channels which intersect in the discharge area (pinch region).

An inlet connection piece 10 with an inlet opening 11 through which an injection device 12 with an injection nozzle 13 is directed to the discharge area is arranged at the first electrode 1.

The purpose of the injection device 12, which is essential to the invention, is to provide a source material for the electric discharge for the emitting plasma in the form of small individual volumes 14 of limited amount ranging in size from $5*10^{-13}$ $cm^3$ to $5*10^{-7}$ $cm^3$. By source material for the electric discharge for the emitting plasma is meant materials containing the chemical element which substantially contributes to the EUV emission in the relevant band for lithography at 13.5 nm. Preferred elements are xenon (Xe), tin (Sn), lithium (Li) and antimony (Sb). The source material can be 100-percent comprised of this chemical element. However, it can also contain other elements which contribute less to EUV radiation and/or elements which do not radiate EUV. By individual volumes of limited amount is meant amounts of source material which are droplets in liquid form or balls in solid form.

The injection device 12 is designed so that in the single event a defined minimum of emitters needed for an efficient generation of radiation is provided in a reproducible manner and introduced into the discharge area. The diameters of the approximately spherically shaped individual volumes 14 are typically on the order of several thousandths to tenths of a millimeter. Regardless of the type of nozzle, distances between the nozzle outlet and the location of the plasma are selected on the order of about 10 cm. As a result of the supplying of source material for the electric discharge carried out by injection, fluctuations in radiation and particle emissions from the radiation source are minimized so that the life of the optics, which depends upon particle emissions, can be increased and transmission losses can be minimized. The cost of particle filters for protecting the optics can likewise be reduced in this way.

Other means, not shown, which serve to protect against erosion and to control temperature can be located between the nozzle outlet and the location of the plasma. Accordingly, the erosion rate at the nozzle opening can be reduced by means of a flight path whose dimensioning and gas pressure are selected in such a way that an atom or ion traversing the flight path undergoes at least 100 collisions with the background gas on average. At least one diaphragm with a free aperture on the order of magnitude of the generated individual volumes is positioned between the discharge area and the injection nozzle for controlling temperature. This diaphragm is preferably cooled.

A gas inlet opening 15 which distributes a background gas uniformly around the z-axis of symmetry Z-Z is inserted into the inlet connection piece 10 concentrically around the injection nozzle 13. In contrast to the conventional Z-pinch gas discharge, the background gas does not itself serve as source material for the electric discharge for the plasma, but rather forms an auxiliary gas which can assist in generating plasma from the limited individual volumes 14 of the source material. For this reason, the background gas, e.g., argon, advantageously has a high EUV transmission.

In a first construction, limited amounts of liquid individual volumes 14 of the source material for the electric discharge are supplied successively to the discharge area by means of the injection device 12. When tin ions, which emit in a highly-efficient manner, are preferred in the plasma 6, pure tin is preferably not used as source material; rather, admixtures are combined with the tin because the narrowest in-band spectrum (i.e., a 2-percent broad band centered at 13.5 nm) is achieved with very small proportions lying outside of this band (out-of-band proportions) in XUV with mixtures added to the tin. Because of their high component stability, compounds such as $SnH_4$ and Sn-nanoparticles mixed with nitrogen or a noble gas, e.g., argon, which do not contain any corrosive components are preferred. The nanoparticles can be added to the nitrogen or argon in the gas phase followed by subsequent liquefaction and injection of the liquefied mixture by means of the injection device 12.

There is a liquid reservoir 16 communicating with a temperature control device 17 which either cools or heats, depending on the kind of source material for the electric discharge, in order to ensure the liquid state of the source material at the input side of the injection nozzle 13 in connection with the reservoir pressure $p_1$.

The frequency, size and spacing of droplets are crucial for providing liquid individual volumes 14 of source material in limited amounts.

The adjustment of a desired flow rate at the outlet of the injection nozzle 13 by means of a continuous reservoir pressure $p_1$ acting on the liquid column in the liquid reservoir 16 results in a droplet frequency which does not lead to the mass limiting required for the plasma. The amount of source material for the electric discharge vaporized by the plasma is in excess of the amount needed for generating radiation, since subsequent droplets are likewise vaporized in the plasma process.

Therefore, "excess" individual volumes 14' are removed from a continuous flow of individual volumes by suitable means so that they do not reach the discharge area. In a first variant for thinning the flow of individual volumes, the individual volumes 14 are electrically charged, the excess individual volumes 14' are then deflected and collected. A charging module 18 and an interceptor 19 make up a component part of a thinning device 20 arranged downstream of the injection nozzle 13.

In another embodiment form, mechanical means, e.g., rotating diaphragms, not shown, which are provided with pass-through areas and intercepting areas, are used to selectively interrupt the flow of individual volumes and admit only selected individual volumes to the discharge area. Of course, means must be provided to prevent the individual volumes that are separated out from adhering to the diaphragm. For example, a suction device that eliminates the vaporized material is suitable for this purpose.

Both embodiment forms are only examples for removing "excess" individual volumes and the invention is not limited to them.

Finally, in another embodiment of the invention (FIG. 2), individual volumes 14 can be provided, if necessary, so that the frequency, the size of the individual volumes 14 and their spacing are determined by periodic pressure modulation. The pressure modulation, e.g., by means of piezo-actuator 21, is exerted on a nozzle chamber 22 which is provided at the injection nozzle 13 on the input side and which communicates with the liquid reservoir 16 and causes a temporary change in volume $\Delta V$ in an area near the injection nozzle 13. There is preferably an equilibrium pressure $p_1=p_2$ on the liquid source material for the electric discharge at the injection nozzle 13 in that a pre-chamber pressure $p_2$ equal to the reservoir pressure $p_1$ in the liquid reservoir 16 is produced via a gas feed 24 between a pre-chamber 23 into which the injection nozzle 13 opens at the nozzle outlet so that no source material can exit without the pressure modulation. Individual volumes 14 of the source material are conveyed out of the injection nozzle 13 in direction of the discharge area depending on the oscillating frequency of the piezo-actuator 21 only when the piezo-actuator 21 is put into operation. In order to ensure this, the pre-chamber 23 has an opening 25 in the injection direction through which the individual volumes 14, which are provided in bursts, can enter. The opening 25 presents a defined flow resistance for a gas that is fed into the pre-chamber 23. Depending on the amount of gas supplied in the pre-chamber 23, the pre-chamber pressure $p_2$ can be adjusted virtually statically, i.e., a stationary gas flow results.

This results in a continuous flow of equidistant individual volumes 14 of identical size with high directional stability. Since the repetition frequency is selectable, the frequency of the plasma generation can advantageously be adapted to so that the two frequencies can be brought into harmony and exactly one individual volume 14 of source material of limited amount is provided for each discharge serving to generate plasma.

The spacing and the velocity of the individual volumes 14 can be further adapted to the process of plasma generation by an acceleration path which can preferably be provided in an area between the injection nozzle 13 and the second electrode 2.

By generating one individual volume 14 of the source material for the electric discharge per discharge process or by removing excess individual volumes 14' from a continuous flow of individual volumes, the source material is completely in the gas phase after the discharge. Consequently, injection can be carried out along the axis of symmetry Z-Z in direction of the radiation outlet and, therefore, in direction of the collimator optics, not shown, since no dense material propagates in direction of the collimator optics. The gas generated from the source material can be intercepted and pumped out by suitable means.

Figure 2:
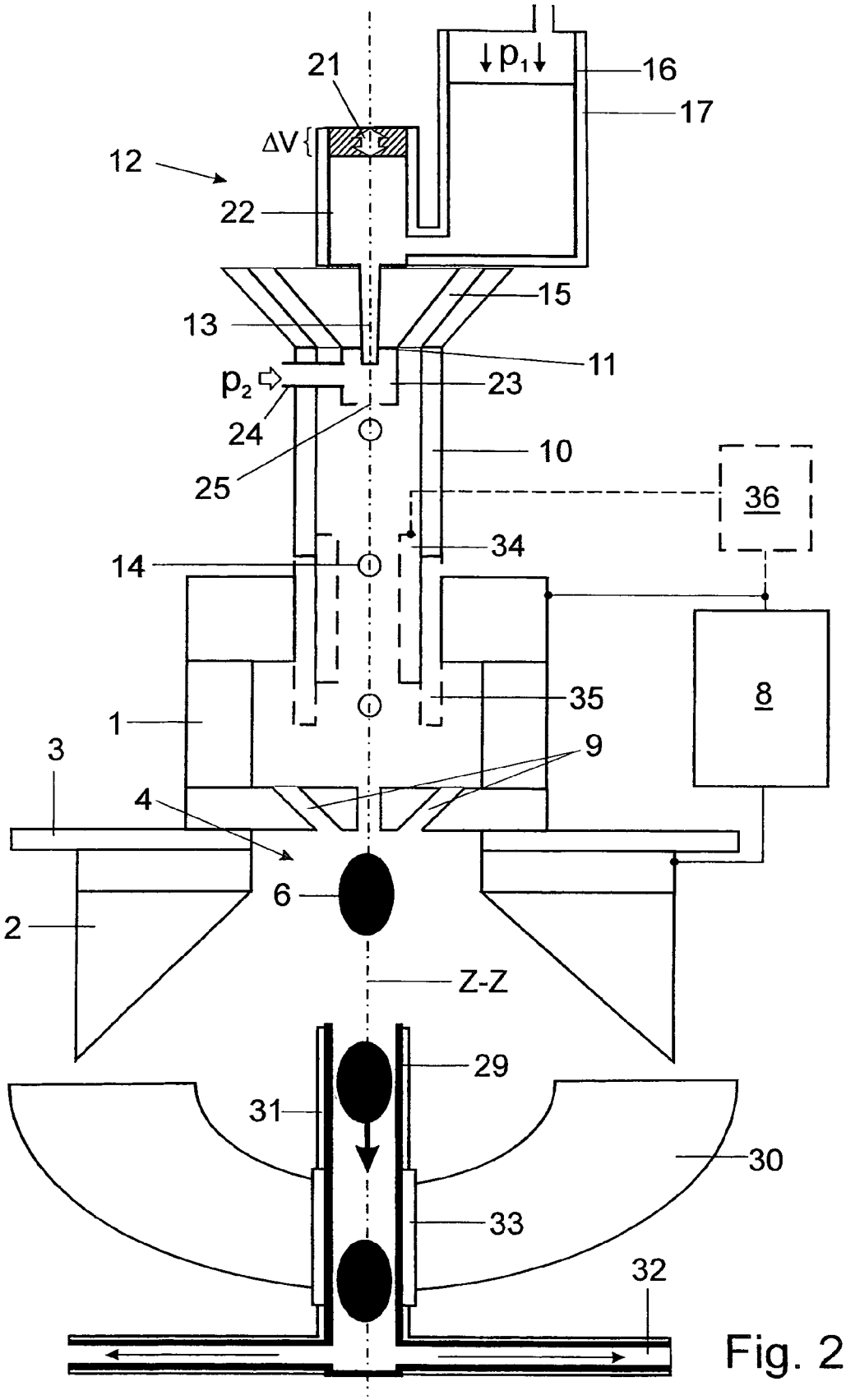
FIG. 2 shows a second construction of an EUV radiation source based on a gas discharge which uses the gas discharge serving to generate plasma for vaporization of injected individual volumes and which contains an intercepting device for the vaporized individual volumes which is integrated in a debris protection device.

The invention provides different ways to generate the plasma from the source material for the electric discharge. On the one hand, the individual volumes 14 of limited amount are vaporized in the discharge area through high-energy radiation such as that of a vaporization laser; on the other hand, the conversion into the vapor phase is carried out through the supply of energy due to the discharge of the background gas (FIG. 2). The vaporization can also be carried out as a combination of both methods.

For laser vaporization, an inlet channel 26 is incorporated in the second electrode 2 so that laser radiation of a vaporization laser 27, which is preferably pulsed, can be directed to the individual volume 17 of limited amount located in the discharge area through the inlet channel 26. An outlet channel 28 affording an exit when necessary (e.g., when the target is missed) is advantageously located opposite the inlet channel. Depending upon the quantity of atoms in the individual volume 14 and upon the laser wavelength, the pulse energy and pulse width are geared toward a complete vaporization of material with a preferably easy, e.g., one-time, ionization and a sufficient time delay between vaporization and the actual generation of plasma. Values typically range from about 0.1 mJ to several tens of mJ and pulse durations of a few nanoseconds. Different, shorter pulse durations of the vaporization laser 27 are also possible.

It is preferable, as is shown in FIG. 1, that the laser radiation of an individual vaporization laser 27 is directed to the target to be vaporized. However, a plurality of vaporization lasers can also be used, and inlet channels which are arranged, e.g., radially symmetrically, in the electrode 2 can lead to the target to be vaporized for their laser radiation. In this case. the total energy is the sum of all of the individual energies of the vaporization lasers that are used. The laser wavelength preferably lies in the UV range and can come from a gas laser or a frequency-multiplied solid state laser. Of course, the selection of lasers is not limited to these two types.

In another construction of the invention, the laser radiation of a vaporization laser 27' can be emitted via the open side of the second electrode 2 (arrow in dashes). Of course, the inlet channel and the outlet channel can be omitted.

The arrangement of the injection direction selected in FIGS. 1 and 2 is preferred because the injection nozzle 13 can be arranged at a freely selectable distance in a location, e.g., whose temperature can be monitored, outside of the optics half-space following the outlet opening. Other geometries, e.g., supplying the source material for the electric discharge via the open side of the second electrode 2, are conceivable but not advantageous. However, it is possible to exchange the laser axis L-L and the axis of the flow of individual volumes of the source material so that the flow of individual volumes travels at right angles to the axis of symmetry Z-Z of the discharge.

Because of the injection of the source material for the electric discharge in direction of the open side of the second electrode 2 and, therefore, of the radiation outlet, the vapor clouds present after the generation of radiation have a preferred component of movement in direction of an off-pump tube 29 which serves as an intercepting device and which is located in the center of a debris mitigation device 30 arranged downstream of the second electrode 2.

The intercepting device, which is preferably heated by at least one connected heating element 31 in order to prevent condensation of elemental components of the source material and to allow metal components in particular, e.g., tin, to be pumped out via a pump connection 32, makes it possible to eliminate large amounts of the work material from the radiation source so as to reduce contamination of the collimator optics. A thermal insulation of the debris mitigation device 30 relative to the intercepting device is achieved by means of a ceramic insulator 33.

Alternatively, the vaporization according to the invention can also be carried out by means of the gas discharge of argon, which is preferably used as an auxiliary gas, in that the corresponding argon plasma is used to convert the limited individual volumes of the source material for the electric discharge to the state of a hot plasma. This method is also advantageous when xenon is used as source material, which is already common, and is introduced into the discharge area as xenon droplets. After the gas discharge has been ignited to generate the argon plasma, this plasma heats the xenon droplet until a xenon plasma emits the desired EUV radiation.

To facilitate the ignition of the gas discharge, a preionization module comprising a first preionization electrode 34, which is electrically insulated from the first electrode 1 serving as second preionization electrode by a tubular insulator 35, is arranged inside the first electrode 1. The voltage for the preionization is supplied by a preionization pulse generator 36 which is connected to the preionization electrode 34 and the first electrode 1.

The method according to the invention has substantial advantages over the previously known procedure in which the total volume of the radiation source was filled with a work gas such as xenon as source material for the plasma emitting the EUV radiation and the plasma was generated from the preionized gas by high-voltage pulses. Since the xenon does not present radially with a relatively constant density distribution, as was formerly the case, but rather is localized with a high density by the injection of individual volumes of limited amount already before the start of the discharge in the near-axis area, smaller plasma sizes and, therefore, higher luminance can be achieved compared with former solutions in spite of large distances between the plasma and the electrodes and insulators. An increased distance between the plasma and the components of the discharge radiation source leads directly to a longer life of the components, since the energy density at the component surface decreases quadratically as the distance increases. The principal disadvantages of discharge arrangements which realize large distances with known means can be eliminated in this way.

Since the xenon which is surrounded by the carrier gas is localized predominantly in the near axis, an appreciable increase in the conversion efficiency for the xenon, which is otherwise advantageous because of its noble gas properties and which does not precipitate on surfaces, can also be realized by means of the invention, resulting in an appreciable reduction in reabsorption in the plasma environment compared to a conventional gas feed.

When metal work materials are used, there is an advantageous minimization of mass.

While the individual volumes of limited amount are introduced into the discharge area so as to be adapted with respect to time to the vaporization with subsequent plasma generation, it may be advantageous to provide steps which completely prevent vaporization of a subsequent volume, which is at least sometimes possible. Another jet of individual volumes, for example, can be suitable. This jet is directed through the discharge space between the plasma and the subsequent volume and does not coincide with the movement direction of the injected individual volumes 14 of limited amount. The individual volumes which shield the subsequent volume from the energy of the plasma appropriately comprise a noble gas, e.g., argon, and do not contain any source materials required for the emitting plasma, so that additional contamination is prevented.

Further, it is possible that the vaporization of the subsequent volume before reaching the discharge area and, therefore, before the actual plasma location can be deliberately used by means of the previously generated plasma as an alternative to laser vaporization or vaporization in the same gas discharge because vaporization of this kind entails a slight expansion, and the material of every volume has a large velocity component in the injection direction because of the injection.

While the foregoing description and drawings represent the present invention, it will be obvious to those skilled in the art that various changes may be made therein without departing from the true spirit and scope of the present invention.

What is claimed is:

1. A device for generating extreme ultraviolet (EUV) radiation on the basis of a discharge plasma comprising:

a discharge chamber having a discharge area for a gas discharge in order to form a plasma that emits the desired radiation;

a first electrode and a second electrode which are electrically separated from one another by an insulator with dielectric rigidity except for a part defining the discharge area;

said second electrode having an outlet opening for the radiation emitted by the discharge plasma;

a high-voltage power supply for generating high-voltage pulses for the two electrodes;

an injection device having an injection nozzle which is directed to the discharge area for injecting a series of individual volumes of a source material for an electric discharge, the source material serving to generate the desired radiation; and means being provided for successive vaporization of the individual volumes in the discharge area;

wherein the injection device and the means for successive vaporization are triggered at a repetition rate corresponding to a frequency that is applied to the high-voltage pulses of the gas discharge.

2. The device according to claim 1, wherein a gas supply unit is provided which supplies a background gas flowing through the discharge area for the gas discharge.

3. The device according to claim 1, wherein the injection device has an injection direction facing toward the outlet opening.

4. The device according to claim 1, wherein the injection device is directed through the outlet opening in the second electrode to the discharge area.

5. The device according to claim 1, wherein the injection nozzle is connected to a liquid reservoir which communicates with a temperature-control device and with a device for providing a continuous reservoir pressure on the source material located in the liquid reservoir.

6. The device according to claim 5, wherein a thinning device which removes excess individual volumes from a continuous flow of individual volumes is arranged downstream of the injection nozzle in the injection direction.

7. The device according to claim 6, wherein the thinning device comprises a module for electrical charging and an interceptor for removal of charged excess individual volumes.

8. The device according to claim 6, wherein the thinning device has a rotating diaphragm having pass-through areas and interception areas which increases the distance between the individual volumes by selectively interrupting the flow of individual volumes and which communicates with means for preventing the adherence of individual volumes that have been separated out.

9. The device according to claim 5, wherein the injection nozzle is connected to the liquid reservoir via an input-side nozzle chamber and a pressure modulator for temporarily changing the volume in the nozzle chamber acts on this liquid reservoir, and wherein the nozzle outlet of the injection nozzle opens into a pre-chamber in which there is a pre-chamber pressure equal to the reservoir pressure and which contains an opening that is directed to the discharge area for the passage of the individual volumes.

10. The device according to claim 1, wherein at least one vaporization laser is provided as means for successively vaporizing the individual volumes.

11. The device according to claim 10, wherein an opening is made in the second electrode through which a laser beam generated by the vaporization laser is guided into the discharge area.

12. The device according to claim 2, wherein the gas discharge of the background gas is provided as means for the successive vaporization of the individual volumes.

13. The device according to claim 1, wherein an intercepting device for the vaporized work medium is arranged in the center of a debris mitigating device arranged downstream of the second electrode.

14. The device according to claim 13, wherein the intercepting device is constructed as an off-pump tube with an inlet opening which faces the outlet opening in the second electrode and with a pump connection, and wherein at least one heating element is connected to the off-pump tube which is at least partially enclosed by an insulating jacket in order to prevent condensation of elemental components of the source material.

15. The device according to claim 2, wherein a preionization module for preionization of the background gas is arranged inside the first electrode, which preionization module comprises a first preionization electrode, which is electrically insulated from the first electrode serving as second preionization electrode by a tubular insulator, and a preionization pulse generator which is connected to the preionization electrode and the first electrode.

16. The device according to claim 1, wherein an acceleration path for the individual volumes is provided in an area between the injection nozzle and the second electrode.

17. A method for generating extreme ultraviolet (EUV) radiation on the basis of a discharge plasma comprising the steps of:

generating a plasma emitting the radiation in a discharge area of a discharge chamber from a source material for an electric discharge, the plasma being generated by a pulsed gas discharge;

providing said source material in the form of individual volumes which are introduced successively through a directed injection into the discharge area vaporizing said individual volumes; and providing high voltage pulses for two electrodes electrically separated from one another by an insulator with dielectric rigidity except for a part defining the discharge area;

wherein said injection of the individual volumes and the subsequent vaporization thereof are triggered at a repetition rate corresponding to a frequency that is applied to the high-voltage pulses of the gas discharge.

18. The method according to claim 17, wherein the vaporized individual volumes are pumped out of the discharge chamber after the plasma generation.

19. The method according to claim 18, wherein the individual volumes are introduced into the discharge space by a continuous injection, wherein excess individual volumes are eliminated before reaching the discharge space.

20. The method according to claim 18, wherein the individual volumes are introduced into the discharge space by a pulsed injection, wherein the pulse train is adapted to the frequency of the gas discharge.

21. The method according to claim 17, wherein the individual volumes are in liquid form in the discharge area before vaporization.

22. The method according to claim 17, wherein the individual volumes are in solid form in the discharge area before vaporization.

23. The method according to claim 17, wherein another flow of individual volumes which does not coincide with the movement direction of the injected individual volumes is directed through the discharge chamber between the plasma generated from a first individual volume and a subsequent volume.

24. The method according to claim 17, wherein at least one laser beam pulse is directed to the individual volume for vaporization, and wherein the gas discharge serving to generate plasma is carried out in the vaporized source material.

25. The method according to claim 17, wherein the vaporization and the plasma generation are carried out by the discharge of a background gas flowing through the discharge chamber.

26. The method according to claim 17, wherein the vaporization is carried out through the combination of at least one laser beam pulse and the discharge of a background gas flowing through the discharge chamber.

27. The method according to claim 25, wherein the background gas is preionized.

28. The method according to claim 17, wherein the source material at least partly contains the elements xenon, tin, lithium or antimony.

29. The method according to claim 28, wherein the source material contains other elements which contribute less to EUV radiation than xenon, tin, lithium or antimony and/or elements which do not radiate EUV.

30. The method according to claim 28, wherein the source material contains tin as $SnH_4$.

31. The method according to claim 28, wherein the source material contains tin in the form of nanoparticles which are mixed with nitrogen or with a noble gas and form the individual volumes as a liquefied mixture.

32. The method according to claim 17, wherein the individual volumes of limited amount range in size from $5*10^{-13}$ $cm^3$ to $5*10^{-7}$ $cm^3$.

* * * * *